United States Patent [19]

Goldammer et al.

[11] 4,379,386

[45] Apr. 12, 1983

[54] APPARATUS FOR INTERRUPTING THE SLIVER SUPPLY IN OPEN-END SPINNING APPARATUS

[75] Inventors: Georg Goldammer, Gaimersheim; Ludwig Schmitt, Manching, both of Fed. Rep. of Germany

[73] Assignee: Schubert & Salzer, Ingolstadt, Fed. Rep. of Germany

[21] Appl. No.: 242,645

[22] Filed: Mar. 11, 1981

[30] Foreign Application Priority Data

Mar. 18, 1980 [DE] Fed. Rep. of Germany ..... 3010303

[51] Int. Cl.[3] ..... D01H 13/18; D01H 7/882

[52] U.S. Cl. ..... 57/405; 57/83; 57/87

[58] Field of Search ..... 57/58.89–58.95, 57/78, 83, 86, 87, 404, 405

[56] References Cited

U.S. PATENT DOCUMENTS

| | | | |
|---|---|---|---|
| 3,695,022 | 10/1972 | Landwehrkamp | 57/87 X |
| 4,008,562 | 2/1977 | Vecera et al. | 57/58.95 |
| 4,043,106 | 8/1977 | Stahlecker | 57/83 X |

*Primary Examiner*—John Petrakes

*Attorney, Agent, or Firm*—Julian W. Dority

[57] ABSTRACT

In an open-end spinning apparatus with an opening roller 2 and a supply device 1, a sliver clamp 5 associated with the supply device 1 is provided to interrupt the sliver feed and can be actuated when the supply roller 10 continues to run by a yarn monitor 31 or a lap monitor 12. In the fiber transport direction, a further, second sliver clamp 6, actuable simultaneously with the first sliver clamp 5 is arranged in front of the supply device 1 at a distance which is as large as the average staple fiber length. Preferably the moving part 62 of the further sliver clamp 6 is rigidly connected to the clamping lever 53 of the first sliver clamp 5.

8 Claims, 4 Drawing Figures

APPARATUS FOR INTERRUPTING THE SLIVER SUPPLY IN OPEN-END SPINNING APPARATUS

BACKGROUND OF THE INVENTION

The present invention relates to an apparatus for interrupting the sliver supply in open-end spinning apparatuses with an opening device and also a delivery apparatus with which is associated a sliver clamp which with the delivery roll continuing to run can be actuated by a yarn monitor or by a lap monitor.

In order of avoid complicated individual drives for the delivery rollers of the individual spinning positions, it is known to associate with the delivery device of each spinning position a sliver clamp which can be actuated when the delivery roller continues to run (U.S. Pat. No. 3,695,022). This sliver clamp is controlled by a control device, for example, a yarn monitor or the central control point for switching the machine on and off, and thus responds on occurrence of a yarn break, in order to interrupt the spinning process at the relevant spinning point; if, however, laps occur on the delivery device, the sliver will also be drawn further into the delivery device by the lap on the delivery roller, even when the sliver clamp is actuated, the result is damage to the delivery device.

It is in fact known to associate a trapping element with the delivery roller (Swiss Pat. No. 570,475). By means of this trapping element, laps are indeed stripped from the delivery roller. However, it is then necessary to remove this stripped lap in time from the region of the delivery roller, since otherwise the housing opening provided for the removal of the stripped lap will be blocked up and serious damage then happen to the delivery device, however, slightly delayed. Such damage occurs, particularly when processing fibers of medium and long staple lengths, and the supply device is equipped with a small belt. The belt makes it practically impossible to eliminate a lap by means of a stripper.

SUMMARY OF THE INVENTION

Since it is thus not possible with the known apparatuses to prevent damage to the delivery roller due to laps, the object of the present invention is to provide a simple apparatus which reliably prevents further sliver feed into the delivery device when lap formation occurs, in spite of the delivery roller continuing to run, and thus prevents the exceeding of a predetermined maximum lap thickness, so that damage to the delivery device is effectively prevented.

This object is achieved by the invention in that a further, second sliver clamp which can be actuated simultaneously with the first sliver clamp is arranged before the delivery device in the fiber transport direction at a spacing which is at least as large as the average fiber staple length. The further sliver clamp, according to the invention, prevents many fibers from reaching the delivery device after they respond on appearance of a lap, in spite of the delivery roller continuing to run. What is more, the sliver is torn apart between the two sliver clamps by the holding back of the sliver by means of the further sliver clamp, so that a given maximum lap thickness cannot be exceeded. This further sliver clamp can be actuated, according to the invention, either by a lap monitor or by a yarn monitor or, when both monitors are provided, by the monitor which responds first. The distance of this further sliver clamp in front of the clamping region of the delivery device is at least as great as the average fiber staple length, so that no fiber damage occurs on simultaneous holding back of the sliver by the further sliver clamp, in spite of the delivery roller continuing to run. What is more, the fibers of the sliver are pulled apart without being damaged.

In order to obtain as rapid as possible an interruption of the fiber feed on response of the further sliver clamp as a result of a lap on the delivery apparatus, the point at which the sliver is pulled apart should be arranged as close as possible to the nip of the delivery apparatus. This is achieved, according to the invention, in that the distance at which the further sliver clamp is arranged in front of the nip of the delivery apparatus amounts to one to two times the average staple fiber length arriving for spinning.

In principle, the further sliver clamp can be actuated by a single control apparatus. However, because the first sliver clamp is appropriately also always actuated on actuation of the further sliver clamp, the two sliver clamps are advantageously connected together for purposes of control. When the further sliver clamp is also, for example, actuated in this manner when a yarn break occurs, it holds the sliver within reach of the operator even when the sliver, for any reason, leaves the clamping point of the first sliver clamp, so that the reintroduction of the sliver into the delivery apparatus, then necessary, is facilitated.

In order to make possible a simple adjustment of the further sliver clamp on the one hand and a reliable operation of the further sliver clamp on the other hand, even when different thicknesses of sliver are processed, according to another feature of the invention, the stationary part of this sliver clamp is displaceable substantially along the clamping path of the moving part of this sliver clamp.

A sliver guide, constructed as a loop catcher, is appropriately provided in front of the clamping point of the further sliver clamp. This sliver guide produces a satisfactory introduction of the sliver into this sliver clamp, independently of the instantaneous position of the supply can, and apart from this prevents the feeding of loops into the spinning element, which would lead to irregularities in the yarn or probably to a yarn break. In order to maintain a simple design, the sliver guide constructed as a loop catcher is an integrated part of this further sliver clamp.

The delivery apparatus has a stationary delivery roll and a feed trough elastically pressed thereagainst as well as a first sliver clamp consisting of a clamp lever cooperating with the feed trough. The clamp lever pivots the feed trough away from the delivery roll when the yarn monitor responds. A clamping end of the clamp lever is constructed as a lap monitor and acts, when it responds, on a moving part of the further sliver clamp. According to a particularly simple and appropriate embodiment of the apparatus, according to the invention, the moving part of the further sliver clamp is here rigidly connected to the clamp lever of the first sliver clamp.

DESCRIPTION OF THE DRAWINGS

The construction designed to carry out the invention will be hereinafter described, together with other features thereof.

The invention will be more readily understood from a reading of the following specification and by reference to the accompanying drawing(s) forming a part thereof, wherein an example of the invention is shown and wherein.

DESCRIPTION OF A PREFERRED EMBODIMENT

Figure 1:
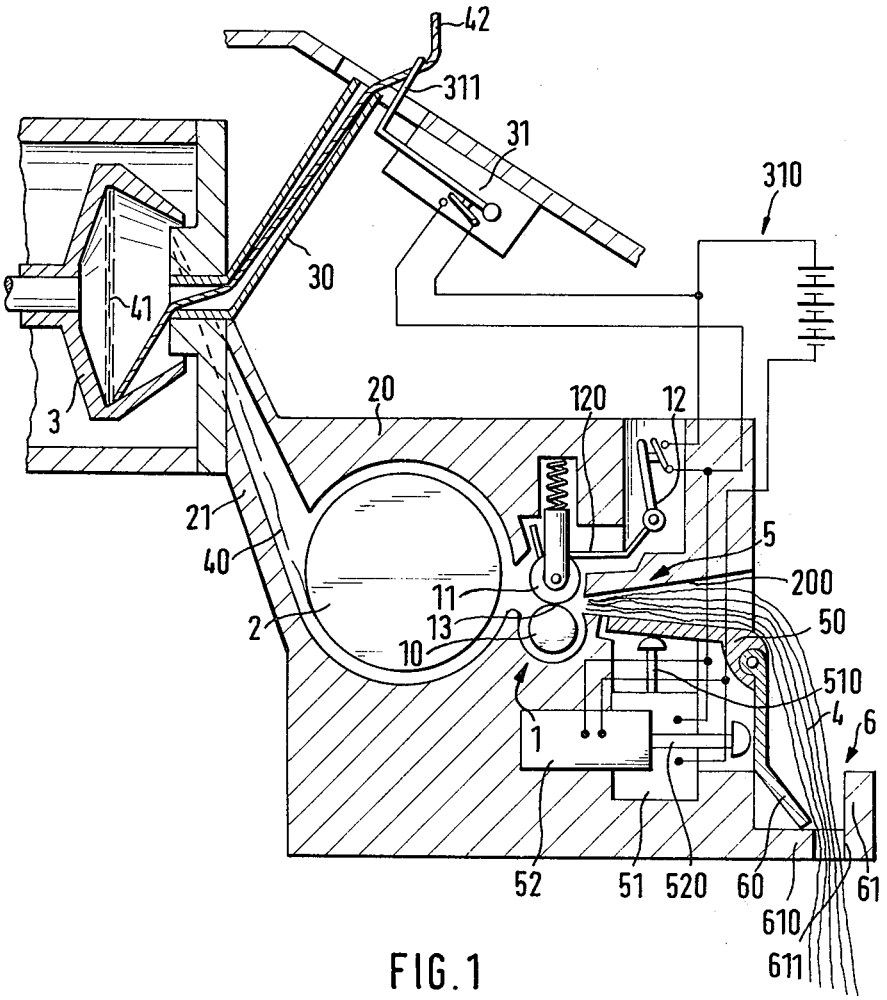
FIG. 1 is a cross sectional view of a spinning position constructed in accordance with the present invention.

As shown in FIG. 1, a sliver 4 opened into individual fibers 40 is fed into the interior of the spinning rotor 3 in the usual way by means of a delivery apparatus 1 and an opening roll 2. The individual fibers 40 reach the collecting trough of the spinning rotor and are formed there into a fiber ring 41. The fiber ring 41 is conveniently bound into the end of a yarn 42 which is drawn off through a yarn takeoff tube 30 by means of a pair of takeoff rolls (not shown) and is conventionally wound onto a bobbin (not shown). The yarn 42 is here monitored on its path to the bobbin by the yarn monitor 31. The reduced pressure in the spinning rotor 3 necessary for spinning is produced in a conventional manner which is therefore not shown.

Figure 2:
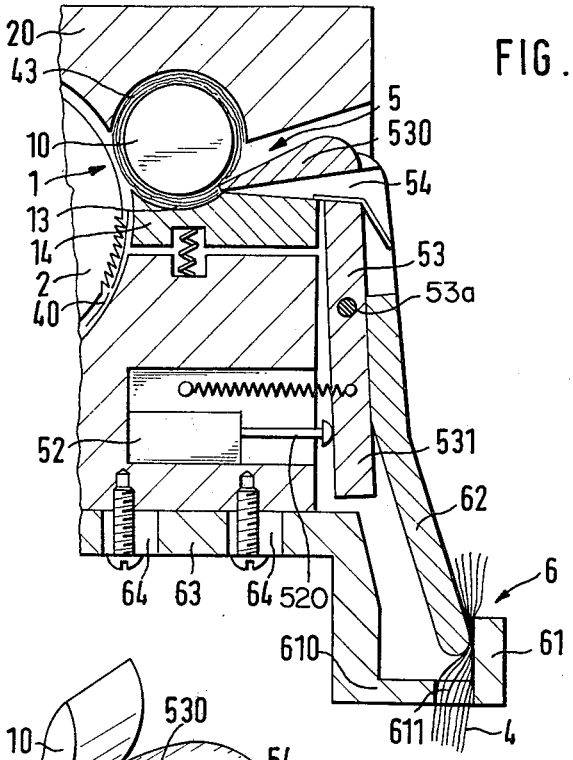
FIG. 2 is a sectional view of a modified form of the invention.

In the example of an embodiment shown, the delivery apparatus 1 has a driven delivery roll 10 and also a pressure roll 11 elastically supported on this and on the periphery of which is elastically applied a feeler 120 of a lap monitor 12 to sense the presence of laps 43 (see FIG. 2).

The opening roll 2 and the delivery apparatus 1 are arranged in a housing 20 which also receives a sliver clamp 5 associated with the delivery apparatus 1. The sliver clamp 5 is located in front of the nip 13 of the delivery apparatus 1 and has a movable clamping element 50 over which the sliver 4 is fed toward the delivery apparatus and which can cooperate with the housing wall 200 that is opposite it in relation to the path of the sliver. For this purpose, the clamping element 50 is pivotably mounted at its end remote from the delivery apparatus 1 and rests on the plunger 510 forming the armature of an electromagnet 51 which is excited when the yarn monitor 31 responds.

The lap monitor 12 is arranged in parallel with the yarn monitor 31 in the control circuit 310 of the electromagnet 51. A further electromagnet 52 is in parallel with the electromagnet 51 and controls with its plunger 520 which forms the armature a further sliver clamp 6 arranged at a spacing in front of the first sliver clamp 5.

The second sliver clamp 6 consists of a pivotable clamping lever 60 which abuts the plunger 520 and a stationary stop 61 against which the clamping lever 60 can be brought to abut. In the embodiment shown, the stop 61 is connected via an intermediate piece 610 to the housing 20. The intermediate piece has an opening constructed as a sliver guide and loop catcher 611.

The apparatus constructionally described above operates as follows:

During the normal spinning process, the sliver 4 passes the loop catcher 611, which eliminates loops in the sliver 4 and ensures that the sliver passes the sliver clamp 6 in a satisfactory state. Apart from this, the loop catcher 611 ensures that the sliver 4, independently of the current position of the supply can, always passes the sliver clamp 6 in the same, exactly established direction, which is important for the satisfactory functioning of this sliver clamp 6.

After passing the sliver clamp 6, the sliver 4 reaches the delivery apparatus 1 via the sliver clamp 5 and is fed to the opening roll 2. The opening roll 2 opens the sliver 4 into individual fibers 40, which reach the spinning rotor 3 via the feed channel 21 and are deposited in the form of a fiber ring 41. They are spun in the rotor into the end of a yarn 42 located in the takeoff and are drawn away by this. The yarn 42 located in the takeoff is monitored by the yarn monitor 31. On occurrence of a yarn break, the yarn monitor 31 closes the control circuit 310 and actuates the two electromagnets 51 and 52. Electromagnet 51, by means of its plunger 510, pivots the clamping element 50 against the sliver 4, which is thus held fast between the clamping element 50 and the housing wall 200 forming a stop, while the delivery roll 10 continues to run on. Thus, only a few more individual fibers 40, located in the delivery apparatus 1, are fed into the spinning rotor 3, so that blocking up of the spinning rotor 3 is effectively prevented.

After the yarn break has been eliminated, the feeler 311 of the yarn monitor 31 is again located in its sensing position and the electromagnets 51 and 52 are again without current so that the sliver clamps 5 and 6 release the sliver 4 again.

However, if for any reason a lap 43 (FIG. 2) forms on the delivery roll 10, the lap monitor 12 responds and now on its part actuates the electromagnets 51 and 52, upon which both sliver clamps 5 and 6 respond. Because of the increased tension exerted on the sliver by the lap 43, sliver clamp 5 is no longer able to hold the sliver 4 back against the tension exerted. Since, however, the further sliver clamp 6 is located at a distance in front of the nip 13 of the delivery apparatus 1 at least a distance as large as the average fiber staple length, this further sliver clamp 6 can effectively hold back the sliver 4. The delivery apparatus 1 pulls apart the sliver held fast by the sliver clamp 6, without giving rise to fiber damage. After the lap 43 has been eliminated, the feeler 120 returns to its working position so that for introduction of the sliver 4 into the delivery apparatus 1, it is sufficient previously to bring the feeler 311 by hand into its sensing position whereby both sliver clamps 5 and 6 release the sliver 4 until, when the normal spinning tension is restored, the feeler 311 is in any case held by the yarn 42 in its sensing position.

If desired, the clamping element 50 and the clamping lever 60 can have tension springs associated with them to hold the clamping element 50 and also the clamping lever 60 in abutment with the plunger 510 or 520, respectively, associated with them.

The spacing between the sliver clamp 6 and the nip 13 of the delivery apparatus must, on the one hand, be large enough to avoid fiber damage, for which reason the average fiber staple length is chosen as the minimum value for this spacing. On the other hand, however, only the smallest possible amount of sliver 4 should be drawn into the delivery apparatus 1 after response of the lap monitor 12, to keep the lap 43 which has already occurred as small as possible, so that damage to the delivery apparatus 1 is avoided and the lap 43 can be eliminated without difficulty. A danger of damage to the delivery apparatus 1 is of different magnitude depending on the design of this apparatus. For example, when fiber feed is by means of aprons, rapid interruption of the fiber supply is particularly important, since the aprons are particularly sensitive to damage.

In the embodiment shown in FIG. 1, both the yarn monitor 31 and also the lap monitor 12 are connected mutually in parallel, in series with the parallel arrangement of the electromagnets 51 and 52 so that both on response of the yarn monitor 31 and on response of the lap monitor both the first sliver clamp 5 and the second sliver clamp 6 always respond. The first and second sliver clamps 5 and 6 are thus interconnected for control purposes. However, it is also possible to actuate the first sliver clamp 5 alone from yarn monitor 31 on occurrence of a yarn break, while the second sliver clamp 6 is actuated alone by the lap monitor 12 when a lap forms on the delivery roll 10. Even with this design of the spinning apparatus, fiber feed into the spinning rotor 3 is reliably interrupted on yarn break, while on lap formation a pulling apart of this sliver 4 is ensured and, hence, exceeding a maximum lap thickness is prevented.

In the embodiment shown in FIG. 1, fiber damage on response of the first sliver clamp 5 is avoided in that, by corresponding arrangement of the electromagnet 51 relative to the clamping element 50 and by corresponding selection of the strength of the electromagnet 51, the clamping pressure of the sliver clamp 5 is chosen to be only so strong that individual fibers 40 can in fact still be pulled out of the sliver 4, but the sliver 4 is otherwise effectively held back.

An apparatus in which fiber damage at the first sliver clamp 5 is avoided in a simpler manner is shown in FIG. 2. The delivery apparatus 1 shown here has a delivery roll 10 and a feed trough 14 elastically supported on it. On the side towards the delivery roll 10, a clamping lever 53 can be brought to abut and has a sliver guide funnel 54, so that the sliver 4 can reach the delivery roll 10 bypassing between the feed trough 14 and the clamping end 530 of the clamping lever 53. The drive end 531 of the clamping lever 53, constructed as a two-armed lever, abuts the plunger 520 of the electromagnet 52. A clamping lever 62 is rigidly connected to the clamping lever 53 and cooperates with the stop 61.

On occurrence of a yarn break, the electromagnet 52 is actuated by the yarn monitor 31 (FIG. 1). The plunger 520 of the electromagnet 52 now pivots the clamping lever 53 about pivot pin 53*a*. The clamping end 531 moves in the direction towards the feed trough 14 engaging the feed trough moving it away from the delivery roll 10, and thus clamps the sliver in between itself and the feed trough 14. Hence, on the one hand, the clamping between the delivery roll 10 and the feed trough 14 is removed and on the other hand, the sliver 4 is held back by this sliver clamp 5 by clamping between the clamping end 530 of the clamping lever 53 and the feed trough 14, so that—without fiber damage—the supply of further individual fibers 40 into the spinning rotor 3 is interrupted. Since the clamping lever 62 of the sliver clamp 6 is rigidly connected to the clamping lever 53—so that the sliver clamps 5 and 6 are again interconnected for control purposes—the clamping lever 62 secures the sliver 4 between itself and the stop 61.

The clamping lever 53 is constructed in the embodiment shown in FIG. 2 as a lap monitor, so that an additional feeler 120 (FIG. 1) is not necessary. The clamping lever 53 can here, if desired, also be provided with a stripper or have one associated with it. If a lap 43 forms on the delivery roll 10, it strikes directly or via a stripper against the clamping end 530 of the clamping lever 53, so that the clamping lever 53 pivots, the feed trough 14 is lifted from the delivery roll 10, and the sliver is clamped between the clamping end 530 of the clamping lever 53 and the feed trough 14. By pivoting of the clamping lever 53 and, hence, also of the clamping lever 62, the sliver 4 is additionally clamped in sliver clamp 6, so that the sliver 4 is pulled apart between the two sliver clamps 5 and 6 when the delivery roll 10 further exerts tension via the lap 43 on the sliver 4.

Since, as a rule, yarn break occurs with the formation of a lap 43, a clamping lever 53 not constructed as a lap monitor can find application in some circumstances. If, however, the clamping lever 53 simultaneously serves as a lap monitor, the sliver clamps 5 and 6 are actuated either by the yarn monitor 31 or by the clamping lever 53, according to which responds earlier.

In order to adjust the sliver clamp 6 independently of the precision of manufacture and, if desired, to adapt it to various sliver thicknesses, the stationary part of the sliver clamp 6 with the stop 61 is constructed with a slide-like mounting 63, the slotted holes 64 of which make possible adjustment of the stop 61 along the clamping path of the moving part, i.e. of the clamping lever 62. Such a possibility of adjustment is in particular appropriate when the two sliver clamps 5 and 6 are mechanically interconnected in order to make possible a matching of the sliver clamp 6 to the sliver clamp 5.

Figure 3:
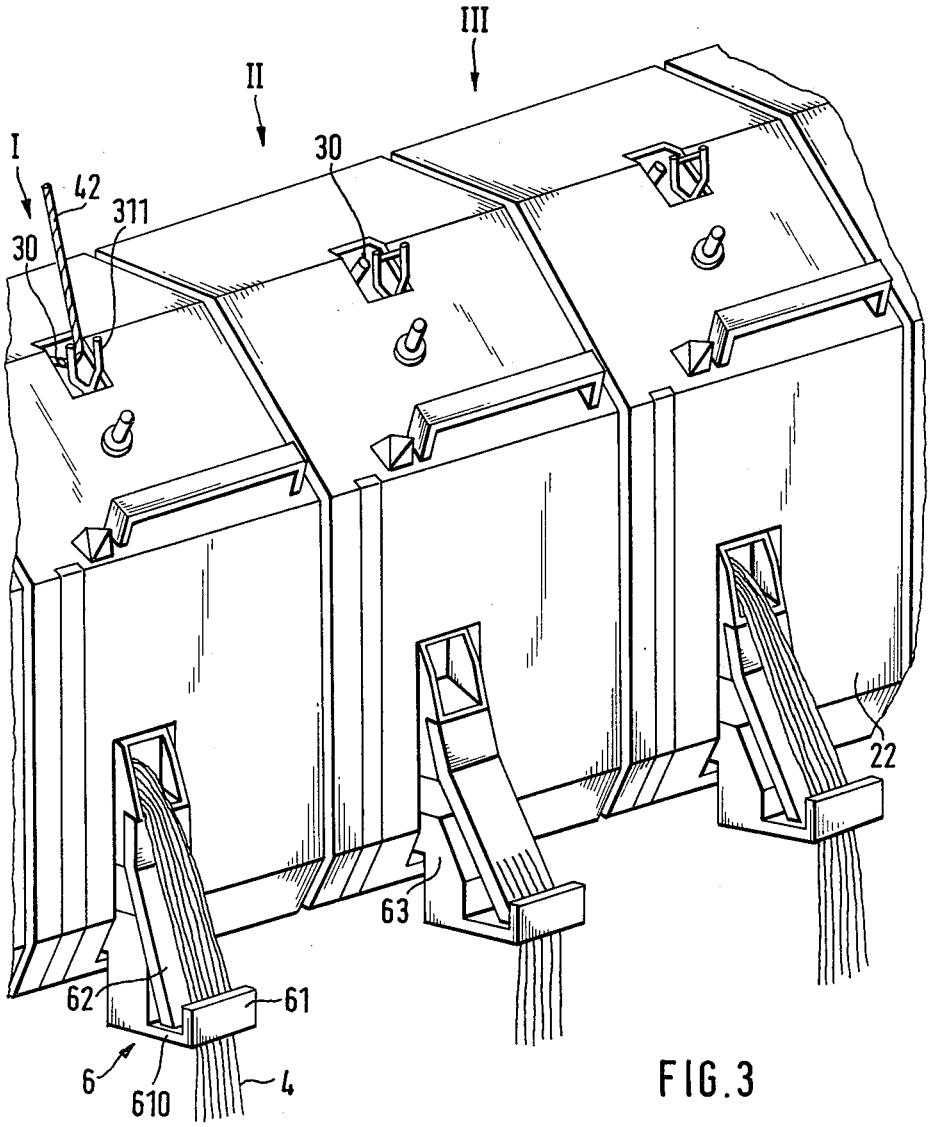
FIG. 3 is a perspective view of the device shown in FIG. 2 with a closed cover thereon.

FIG. 3 shows the apparatus shown in FIG. 2 without a cover in its three working positions.

In the working position I, the spinning process is not interrupted; the yarn 42 is continuously drawn away from the spinning position, which is continuously supplied with sliver 4.

At the spinning position II, a lap 43 (FIG. 2) has appeared so that as a result of response of the sliver clamp 6, the sliver 4 is pulled apart. Apart from this, a yarn break has occurred at this spinning position II; as a rule, this occurs simultaneously with the beginning of the lap formation, but at the latest on interruption of the feed of sliver.

Finally, at spinning position III, only a yarn break has occurred without simultaneously leading to lap formation. The sliver clamps 5 (FIG. 2) and 6 (FIGS. 2 and 3) have responded and hold the sliver 4 back.

Figure 4:
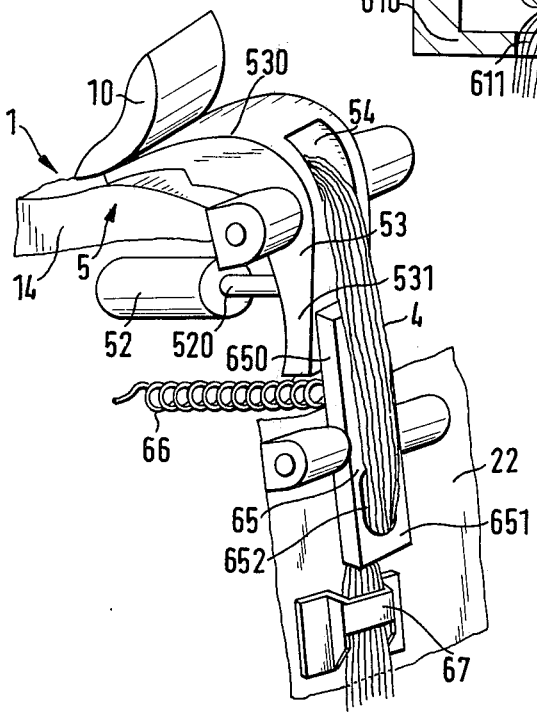
FIG. 4 is a perspective view of a modified form of the invention.

FIG. 4 shows an alternative solution, in which the sliver clamp 6 has a two-armed clamping lever 65, the one arm 650 is held by a tension spring 66 in abutment on the drive end 531 of the clamping lever 53, while the other arm 651, on excitation of the electromagnet 52, is brought to abut on the cover 22 serving as a stop clamping the sliver between the inner surface of the arm 651 and the cover 22. The arm 651 of the clamping lever 65 has a guide hole 652 to guide the sliver 4.

On release of the sliver clamp 5, the sliver clamp 6 is released in this embodiment also. Likewise, the two sliver clamps 5 and 6 reach their clamping position by response of the electromagnet 52 or on sensing of a lap 43 by the clamping lever 53 constructed as a lap monitor.

In the embodiments shown in FIGS. 1 and 3, the fiber guide forming a loop catcher 611 is an integral part of the sliver clamp 6. FIG. 4 shows that it is completely possible to construct a loop catcher 67 independently of the sliver clamp 6.

Further developments of the object of the invention by reciprocal exchange of the described features and by substitution by equivalents lie within the scope of the present invention.

What is claimed is:

1. Apparatus for interrupting the sliver supply in an open-end spinning machine which includes an opening device, a sliver delivery device, a first sliver clamp associated with said sliver delivery device, means including a yarn monitor or a lap monitor when a supply roller continues to run for actuating said sliver clamp, comprising:

a second sliver clamp means actuatable simultaneously with said first sliver clamp for clamping said sliver;

said second sliver clamp means being arranged before said sliver delivery device in the transport direction at a distance which is at least as large as the average fiber staple length.

2. Apparatus according to claim 1 further comprising: said distance at which said second sliver clamp is arranged in front of said delivery device amounts to one to two times the average fiber staple length arriving for spinning.

3. Apparatus according to claim 1 further comprising: said second sliver clamp is operable to be actuated with said first sliver clamp.

4. Apparatus according to claim 1 further comprising: said second sliver clamp including, (i) a movable clamping lever;

(ii) an adjustable stop carried on an opposite side of the path of said sliver for clamping said sliver thereagainst when said movable clamping lever is forced thereagainst when said clamp is actuated.

5. Apparatus according to claim 1 further comprising: a sliver guide constructed as a loop catcher positioned in front of the clamping point of said second sliver clamp.

6. Apparatus according to claim 5 further comprising: said sliver guide is an integrated component of said second sliver clamp.

7. Apparatus according to claim 1 wherein said delivery device includes a stationary delivery roller and a feed trough elastically pressed thereagainst, said first sliver clamp including a clamp lever cooperating with said supply trough, said clamping lever pivoting said feed trough away from the delivery roller when activated by said means including said yarn monitor, further comprising:

a movable clamping lever forming part of said second clamp means;

a clamping end of said first clamp lever being constructed as a lap monitor and upon sensing a lap buildup acts on said movable clamping lever of said second sliver clamp means clamping said sliver.

8. Apparatus according to claim 7 further comprising: said movable lever of said second sliver clamp is rigidly connected to said clamp lever of said first sliver clamp.

* * * * *